US008100664B2

(12) United States Patent
Hwang et al.

(10) Patent No.: US 8,100,664 B2
(45) Date of Patent: Jan. 24, 2012

(54) IMPELLER FOR A COOLING FAN

(75) Inventors: Ching-Bai Hwang, Taipei Hsien (TW); Jie Zhang, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 1111 days.

(21) Appl. No.: 11/937,403

(22) Filed: Nov. 8, 2007

(65) Prior Publication Data

US 2009/0041585 A1 Feb. 12, 2009

(30) Foreign Application Priority Data

Aug. 8, 2007 (CN) ..... 2007 1 0075640

(51) Int. Cl.
*F04D 29/30* (2006.01)

(52) U.S. Cl. ..... 416/236 R

(58) Field of Classification Search ..... 416/28, 416/235, 236 R, 223 B
See application file for complete search history.

(56) References Cited

U.S. PATENT DOCUMENTS

| | | | | |
|---|---|---|---|---|
| 5,064,346 | A * | 11/1991 | Atarashi et al. | 416/178 |
| 6,568,907 | B2 * | 5/2003 | Horng et al. | 416/185 |
| 7,063,510 | B2 * | 6/2006 | Takeshita et al. | 416/210 R |
| D532,903 | S * | 11/2006 | Hirata et al. | D23/413 |
| D563,544 | S * | 3/2008 | Hwang et al. | D23/413 |
| 2005/0095132 | A1 | 5/2005 | Kao et al. | |
| 2006/0204363 | A1 * | 9/2006 | Yen et al. | 416/228 |

FOREIGN PATENT DOCUMENTS

| | | |
|---|---|---|
| CN | 1088667 A | 6/1994 |
| CN | 1500998 A | 6/2004 |

* cited by examiner

*Primary Examiner* — Nathaniel Wiehe
(74) *Attorney, Agent, or Firm* — Altis Law Group, Inc.

(57) ABSTRACT

An impeller (10) for a cooling fan includes a hub (20) having a circular wall (22) and an annular sidewall (24) extending upwardly from a periphery of the circular wall, and a plurality of blades (30) extending radially from the sidewall of the hub. Each of the blades includes a first portion (32) near the hub and a second portion (34) away from the hub, wherein each of the second portions has a pair of opposite ribs (36) formed on two lateral sides thereof, thereby reducing a noise level generated by the impeller when the impeller rotates.

17 Claims, 3 Drawing Sheets

IMPELLER FOR A COOLING FAN

BACKGROUND OF THE INVENTION

1. Field of the Invention

The present invention relates to an impeller, and more particularly to an impeller for a cooling fan, wherein the impeller has blades each having an improved structure.

2. Description of Related Art

With continuing development of the electronic technology, electronic components such as CPUs generate more and more heat that is required to be dissipated immediately.

Conventionally, a fan is used to produce an airflow that can remove heat from the electronic component. The fan comprises a stator and a rotor being rotatable with respective to the stator. The rotor further comprises a hub and a plurality of blades extending radially from the hub. In use, the blades of the rotor rotate around the stator to engender the airflow towards the electronic component, thus cooling the electronic component continuously.

Increasing a revolving speed of the fan blades relatively increases the amount of airflow, therefore a heat dissipation efficiency is relatively improved. However, increasing the revolving speed may cause a noise level generated by the fan to raise correspondingly, thus making a user near the fan feel uncomfortable.

What is needed, therefore, is a impeller which can overcome the above-mentioned disadvantage.

SUMMARY OF THE INVENTION

An impeller for a cooling fan includes a hub having a circular wall and an annular sidewall extending upwardly from a periphery of the circular wall, and a plurality of blades extending radially from the sidewall of the hub. Each of the blades includes a first portion near the hub and a second portion away from the hub, wherein each of the second portions has a pair of opposite ribs formed on two lateral sides thereof and located adjacent to the first portion, thereby reducing a noise level generated by the blades when the impeller rotates.

Other advantages and novel features of the present invention will become more apparent from the following detailed description when taken in conjunction with the accompanying drawings, in which:

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION OF THE INVENTION

Figure 1:
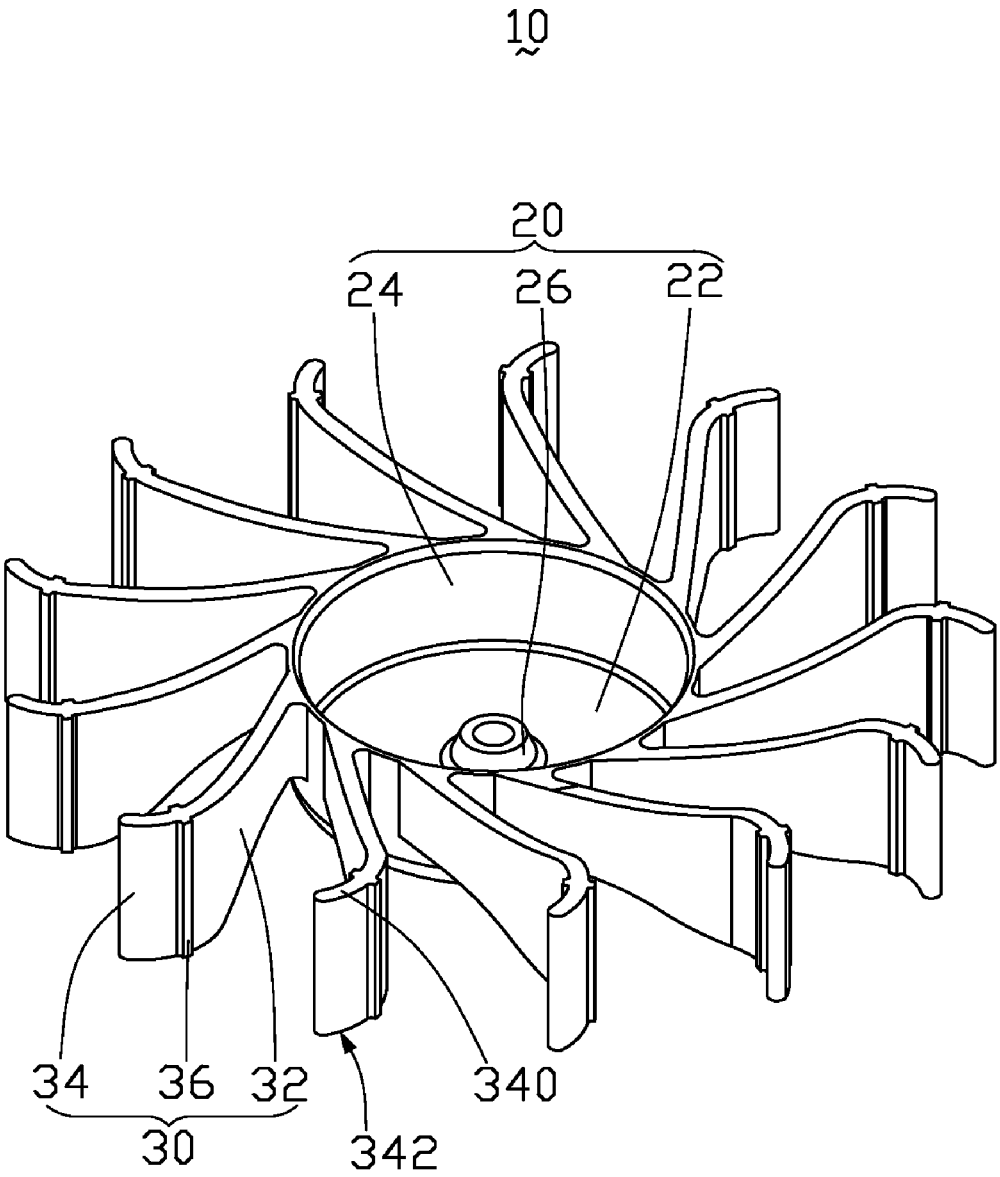
FIG. 1 is an isometric view of an impeller in accordance with a preferred embodiment of the present invention.

Referring to FIG. 1, an impeller 10 for a cooling fan (not shown) of a preferred embodiment of the present invention comprises a hub 20 and a plurality of blades 30 extending radially from a periphery of the hub 20.

The hub 20 comprises a circular wall 22 and an annular sidewall 24 extending upwardly and perpendicularly from a periphery of the circular wall 22 in a manner that a cylindrical space (not labeled) is defined between the circular wall 22 and the sidewall 24. A protrusion 26 projects upwardly from a central area of a top face of the circular wall 22, wherein a cross-sectional area of the protrusion 26 gradually decreases along an upward direction, thereby forming a tapered configuration for the protrusion 26. A hole (not labeled) is defined at a top face of the protrusion 26 to engage with a shaft (not shown), thus allowing the hub 20 to perform a rotation in respective to a bearing (not shown) in which the shaft extends.

The blades 30 extend radially from the sidewall 24 of the hub 20. The blades 30 are arranged on the hub 20 in balance for preventing the impeller 10 from rotating unstably. Each of the blades 30 comprises a first portion 32 slantwise fixed to the sidewall 24 of the hub 20, a second portion 34 curved from a distal end of the first portion 32, and a pair of opposite ribs 36 formed oppositely on the second portion 34 at an end thereof adjacent to the first portion 32. Two adjacent first portions 32 are spaced from each other with outwardly increasing distances therebetween. Also referring to FIG. 3, each of the first portions 32 has a curved top face 320 coupling with a top face (not labeled) of the annular wall 24, an arced bottom face 322 connecting an outer surface (not labeled) of the annular wall 24, and a pair of opposite lateral faces 324 extending outwardly from the outer surface of the annular wall 24 and between the top face 320 and the bottom face 322. The pair of lateral faces 324 are substantially planar and parallel to each other (shown in FIG. 2).

Figure 2:
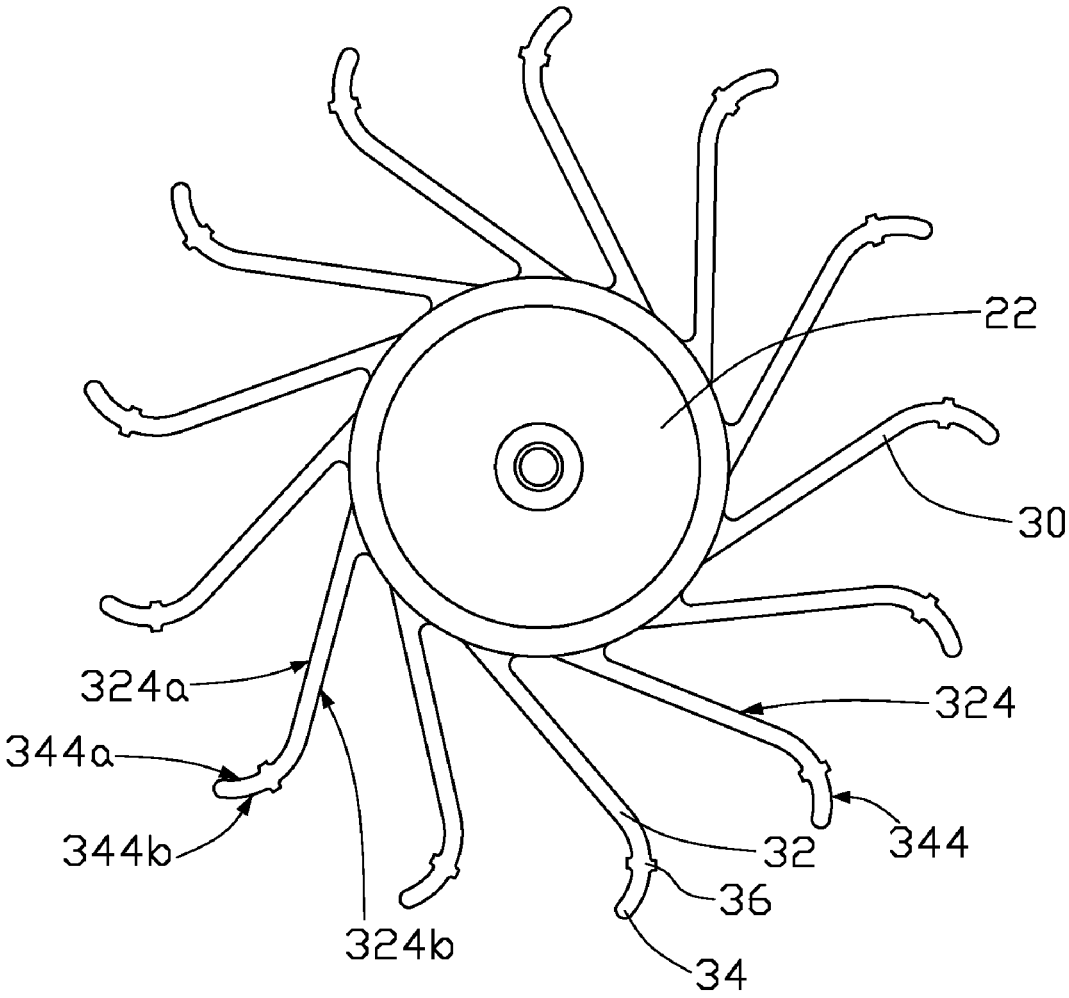
FIG. 2 is a front view of FIG. 1.
Figure 3:
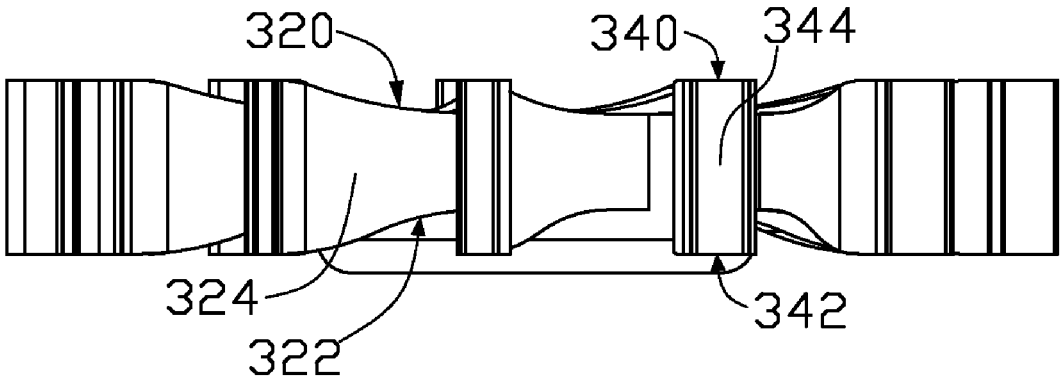
FIG. 3 is a side view of FIG. 1.

Each of the second portions 34 has a top face 340 extending from the top face 320 of the first portion 32, a bottom face 342 extending from the bottom face 322 of the first portion 32, and a pair of opposite lateral faces 344 extending from the pair of lateral faces 324 of the first portion 32, respectively. Each of the top faces 340 of the second portions 34 is oriented parallel to each of the bottom faces 342 of the second portions 34 and the circular wall 22 of the hub 20. The top faces 340 of the second portions 34 are coplanar with each other, and the bottom faces 342 of the second portions 34 are coplanar with each other, too. Referring to FIG. 2, the lateral faces 344 are concentric with each other, and connected with each other with an arced surface (not labeled) therebetween, which is formed at a free end of each of the second portions 34 of the blades 30. One of the pair of lateral faces 344 of the second portion 34 is a concave surface 344*a*, another one of the lateral faces 344 of the second portion 34 is a convex surface 344*b*, wherein the concave surface 344*a* is tangent with a corresponding lateral face 324*a* of the first portion 32 to define a smoothly windward side for the blade 30, and the convex surface 344*b* is tangent with another corresponding lateral face 324*b* of the first portion 32 to define a smoothly leeward side for the blade 30, thus allowing the impeller 10 to produce a required airflow wind when it rotates clockwise as viewed from FIG. 1.

Referring to FIG. 1 again, the pair of ribs 36 project from the pair of lateral faces 344 of the second portions 34 respectively in a manner that the pair of ribs 36 are opposing to each other. Each of the ribs 36 has a rectangular configuration and extends along a height direction of the second portion 34 from the bottom face 342 to the top face 340 of the second portion 34. The pair of ribs 36 are parallel to each other.

In a performance analysis of the cooling fan with the impeller 10 of the present invention, under the same condition of air pressure and air flow rate, a noise level of the fan with the impeller 10 is apparently lower than that of a conventional fan (not shown), due to the blades 30 of the impeller 10 having the ribs 36. The ribs 36 of the blades 30 function to lower the amplitude of the harmonic wave of the sound generated by the rotation of the impeller 10, thereby reducing the noise level.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An impeller adapted for being used in a cooling fan, comprising:

a hub; and a plurality of blades extending radially and outwardly from a periphery of the hub, each of the blades having a pair of opposite ribs formed from two lateral sides thereof, for reducing a noise level generated by the impeller when the impeller rotates;

wherein the hub comprises a circular wall and an annular sidewall extending upwardly from a periphery of the circular wall, the blades extending radially and outwardly from a periphery of the annular wall;

wherein each of the blades comprises a first portion connecting with the annular sidewall of the hub, and a second portion curved outwardly from the first portion; and wherein the first portion of the blade has a top face coupling with a top surface of the annular sidewall of the hub, a pair of opposite lateral faces connecting an outer surface of the annular sidewall of the hub, and a bottom face attached to the outer surface of the annular sidewall of the hub.

2. The impeller as claimed in claim 1, wherein the second portion has a top face coupling with the top face of the first portion, a pair of opposite lateral faces extending from the pair of opposite lateral faces of the first portion respectively, and a bottom face connecting with the bottom face of the first portion.

3. The impeller as claimed in claim 2, wherein one of the pair of opposite lateral faces of the second portions is a concaved surface, and another one of the pair of opposite lateral faces of the second portion is a convex surface that is concentric with the concaved surface.

4. The impeller as claimed in claim 3, wherein the concaved surface of the second portion is tangent with a corresponding one of the pair of lateral faces of the first portions to define a windward side, and the concaved surface of the second portion is tangent with another corresponding one of the pair of lateral faces of the first portions to define a leeward side.

5. The impeller as claimed in claim 3, wherein the top face of the second portion is parallel to the bottom face of the second portion and the circular wall of the hub.

6. The impeller as claimed in claim 3, wherein the pair of opposite ribs are formed at the pair of opposite lateral faces of the second portion respectively.

7. The impeller as claimed in claim 3, wherein each of the pair of opposite ribs extends along a height direction from the top face to the bottom face of the second portion.

8. The impeller as claimed in claim 3, wherein the pair of opposite ribs are parallel to each other and located at a position of the second portion near the first portion, the pair of opposite ribs each having a rectangular configuration.

9. A fan blade set for a cooling fan, comprising:

a hub comprising a circular wall and an annular wall extending upwardly from a periphery of the circular wall; and a plurality of blades extending radially from the annular wall of the hub, each of the plurality of blades having a first portion near the hub, and a second portion away from the hub, the second portion having a pair of opposite ribs formed on two lateral faces thereof respectively for reducing a noise level generated by the fan blade set when the fan blade set rotates;

wherein the first portion comprises a top face coupled with a top face of the annular wall of the hub.

10. The fan blade set as claimed in claim 9, wherein the first portion is slantwise extended from the annular wall of the hub.

11. The fan blade set as claimed in claim 9, wherein the second portion is bent along a clockwise orientation from a free end of the first portion to form a curved configuration.

12. The fan blade set as claimed in claim 9, wherein the pair of ribs extend along a height direction of the second portion.

13. The fan blade set as claimed in claim 9, wherein the pair of ribs are located at a position of the second portion near the first portion.

14. An impeller for a cooling fan comprising:

a hub having a circular wall and a sidewall extending upwardly from a periphery of the circular wall; and a plurality of blades extending radially and outwardly from the sidewall, wherein each of the blades has a top surface coplanar with a top face of the sidewall, a bottom surface connecting with an outer surface of the sidewall, a pair of lateral surfaces between the top and bottom surfaces of the each of the blades, and a pair of ribs extending laterally and oppositely from the pair of lateral surfaces, respectively.

15. The impeller as claimed in claim 14, wherein the each of the blades has a slantwise first portion connecting with the sidewall of the hub and a curved second portion connecting with a free end of the first portion, the pair of ribs being extended from the second portion.

16. The impeller as claimed in claim 15, wherein the pair of ribs is extending from the second portion at a position near the first portion.

17. The impeller as claimed in claim 16, wherein the pair of ribs extends along a height direction from the top surface to the bottom surface of the each of the blades.

* * * * *